United States Patent [19]

Claflin et al.

[11] 4,019,366

[45] Apr. 26, 1977

[54] VARIABLE PARAMETER SMOKING MACHINE

[75] Inventors: Warren E. Claflin, Chesterfield; Francis M. Watson, III, Richmond, both of Va.

[73] Assignee: Philip Morris Incorporated, New York, N.Y.

[22] Filed: Nov. 4, 1975

[21] Appl. No.: 628,776

[52] U.S. Cl. ..... 73/23; 131/171 R

[51] Int. Cl.[2] ..... G01N 1/26

[58] Field of Search ..... 73/23, 28; 131/171 R

[56] References Cited

UNITED STATES PATENTS 3,548,841 12/1970 Caughey ..... 131/171

*Primary Examiner*—James J. Gill

*Attorney, Agent, or Firm*—Cushman, Darby & Cushm

[57] ABSTRACT

A variable parameter smoking machine for smoking one or more cigarettes that allows adjustment of the puff flow, duration, and interval for the cigarettes being smoked. Cigarette holders are placed in fluid circuit parallel with dummy air-flow resistance valves, and either the holder or dummy load is placed in operative communication with a continuous vacuum source by a solenoid-operated valve associated with each holder and dummy load. A flow-adjustable valve is also associated with each holder and dummy load. Each holder-dummy-valve system is connected to a pressure manifold, which in turn is connected through a circuit having a flowmeter and flowmeter bypass line arranged in parallel to the continuous vacuum source.

9 Claims, 4 Drawing Figures

22
23
20
24
17
16
21
18
13
14
52
4
4
30
28
28
55
48
53
56
59
57

VARIABLE PARAMETER SMOKING MACHINE

BACKGROUND AND SUMMARY OF THE INVENTION

The invention relates to a smoking machine for testing cigarettes and the like by drawing smoke therethrough in a manner closely simulating human smoking of cigarettes, and for optionally testing the cigarette smoke therefrom. Prior art devices in the field of the invention, such as shown in U.S. Pat. Nos. 3,460,374 and 3,433,054 are successful in simulating human smoking, however, they generally have very restricted operational parameters. For instance, the "puff" duration and interval have not been readily adjustable, or the flow through the cigarette during a puff. For instance, U.S. Pat. No. 3,460,374 provides a device having a generally constant volume cylinder for receiving smoke from a cigarette holding means, which limits the puff duration achievable, and U.S. Pat. No. 3,433,054 provides a sequentially movable indexing means, which limits the adjustability of the puff interval.

According to the present invention, a smoking machine is provided that has easily adjustable means for varying smoking parameters over a wide range, including the puff duration, interval, and the flow, such means being associated with one or more smoking ports for varying the flow characteristics of each port.

According to the present invention, a source of substantially constant vacuum is provided. Solenoid-operated valve means are provided for selectively providing operative communication between the vacuum source and holding means for the cigarettes to be tested or dummy flow resistance means for simulating the resistance to flow of the cigarettes in fluid circuit parallel with said holding means. The flow through each cigarette is adjusted by a variable flow valve in fluid circuit with the cigarette and vacuum source, and may be tested by a flowmeter in the circuit. A by-pass for the flowmeter is provided so that it is not constantly subjected to smoke passing therethrough. A reservoir is provided connected to a vacuum pump, and a relief valve is associated with the reservior. A manifold is provided between the vacuum source and each of the cigarette holding means.

It is the primary object of the present invention to provide a smoking machine with widely variable smoking parameters. This and other objects of the invention will become clear from an inspection of the detailed description of the invention, and from the appended claims.

DETAILED DESCRIPTION OF THE INVENTION

Figure 1:
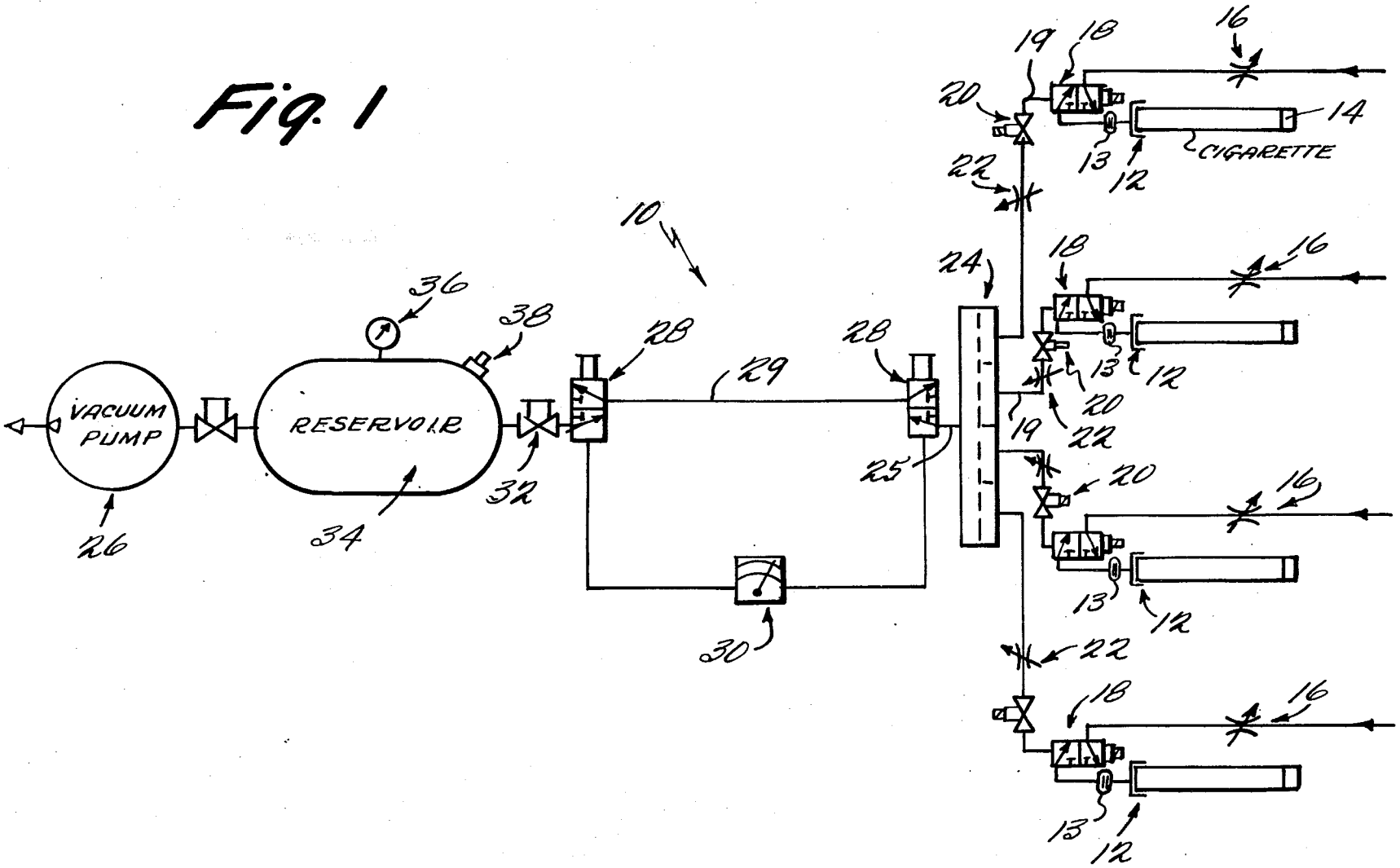
FIG. 1 is a diagrammatic view of an exemplary smoking machine according to the present invention including fluid circuit therefor.

An exemplary smoking machine according to the present invention is shown diagrammatically at 10 in FIG. 1. The machine consists generally of a plurality of holding means or ports 12 each for holding cigarettes or the like to be smoked selectively, connected in fluid circuit parallel with a dummy air-flow resistance means 16 to a vacuum source 26 via remotely operated valves 18. In particular, each holding means 12 includes a tubular member which holds a cigarette 14 for smoking and allows air to be selectively drawn through the cigarette 14 during each puff thereof. A Cambridge filter 13 or the like may be associated with each means 12 as a means for trapping and condensing elements of smoke from cigarettes held by such means 12. When valve 18 is in one position, air is drawn through the cigarette 14 by vacuum source 26, and a puff of a given duration is effected. After the predetermined time period for the puff elapses, the valve 18 is moved to a second position thereof wherein no air is drawn through the cigarette 14, but instead is drawn through the dummy load 16 in fluid circuit parallel with hold means 12, which dummy means is provided by a variable flow valve with manual adjustment means 17 (see FIG. 3) therefor. The flow valve 16 is set so that it has substantially the same resistance to flow (load) as the cigarette 14 so that there is no substantial variation in the amount of air drawn in by vacuum means 26 between the two positions of the valve 18, and so that there is no build-up or decrease in the negative pressure supplied by the source 26 in between puffs.

Each valve 18 is preferably solenoid controlled, and is connected by a line 19 from the holding means 12 and dummy load 16 to a manifold 24. Disposed in line 19 may be a solenoid operated shut-off valve 20, and a manually adjustable variable flow valve 22. The valve 20 is especially useful for shutting off flow from all other ports or holding means 12 when the flow through one is being adjusted, and varible flow valve 22 is adjusted to control the flow from the cigarette 14 or the like to provide for variations in puffing suction. A filter 21 or the like (see FIG. 3) may also be disposed in line 19 if desired.

The lines 19 and 29, and the pressure manifold 24, comprise means for operatively connecting the continuous source of vacuum 26 to the plurality of holding means 12 and the plurality of dummy air-flow resistance means 16.

Air and smoke flowing through the manifold 24 flows through line 25 to either flowmeter by-pass line 29 or flowmeter 30. Line 29 and flowmeter 30 are placed in parallel in the fluid circuit, and the flow thereto is controlled by a pair of solenoid-operated valves 28. In one position of the valves 28, the air from line 25 flows through line 29 directly toward vacuum pump 26, while in a second position of the valves 28 the air flows through flowmeter 30 before flowing toward vacuum pump 26. In this way, the flowmeter 30 will only be in the fluid circuit when the flow is to be measured, and thus will not be subjected to any damaging effects from smoke constantly flowing therethrough. Each valve 28 may have a third no-flow position if desired. The flow through flowmeter 30 may be visually determined by glancing at electronic readout 42 therefor (see FIG. 2).

After passing through valves 28, the air may flow through a main shut-off valve 32, and into a reservoir 34. The vacuum in reservoir 34 is controlled by vacuum pump 26 and by relief valve 38, and the vacuum therein may be read from gauge 36. Various component parts of the system may be seen more clearly in FIGS. 2–4. Mounted on a control panel 40 are controls for all of the electronic components of the machine according to the present invention, such as the controls 41 for the timed solenoid-operated valves 18 (for adjustment of puff interval and duration), the controls 43 for the solenoid-operated on-off valves 20, the controls 45 for the solenoid-operated valves 28, and the controls 47 for the solenoid-operated valve 32. It will be seen that according to the present invention the puff interval, puff duration, puff flow rate, and vacuum may all be readily adjusted to provide for a wide variety of smoking parameters. The puff interval and duration for each port is determined by the timing of the respective solenoid-controlled valve 18, the puff rate for each port is determined by the position of respective valve 22 (and the vacuum supplied through reservoir 34), and the vacuum may be adjusted by controlling the pump 26 and the relief valve 38. All of the component parts of the device according to the present invention may be mounted in a movable cabinet 39 or the like if desired.

Figure 2:
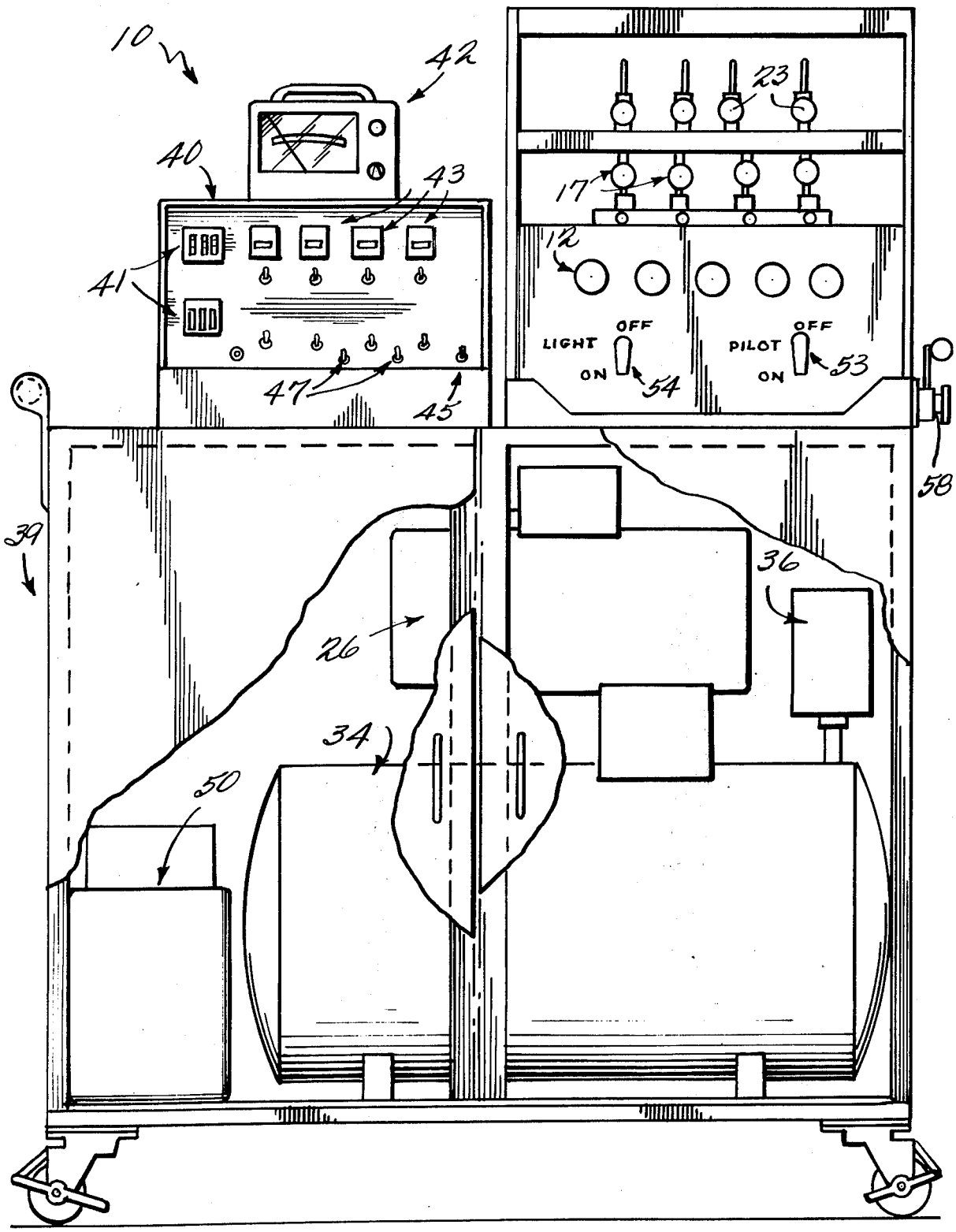
FIG. 2 is a front detail view of exemplary apparatus according to the present invention.
Figure 3:
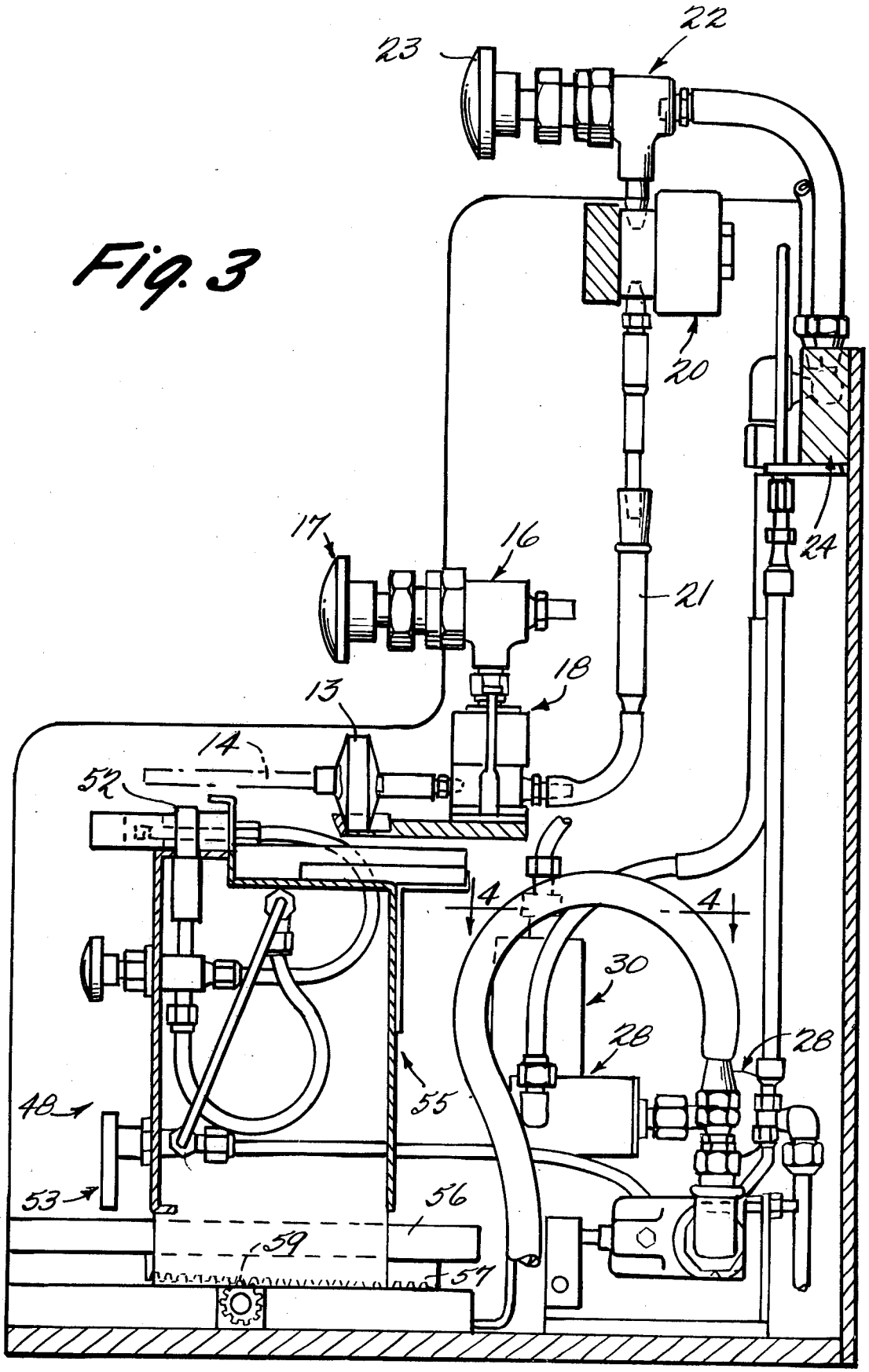
FIG. 3 is a side view, with the cabinet cut away, of the apparatus of FIG. 2.
Figure 4:
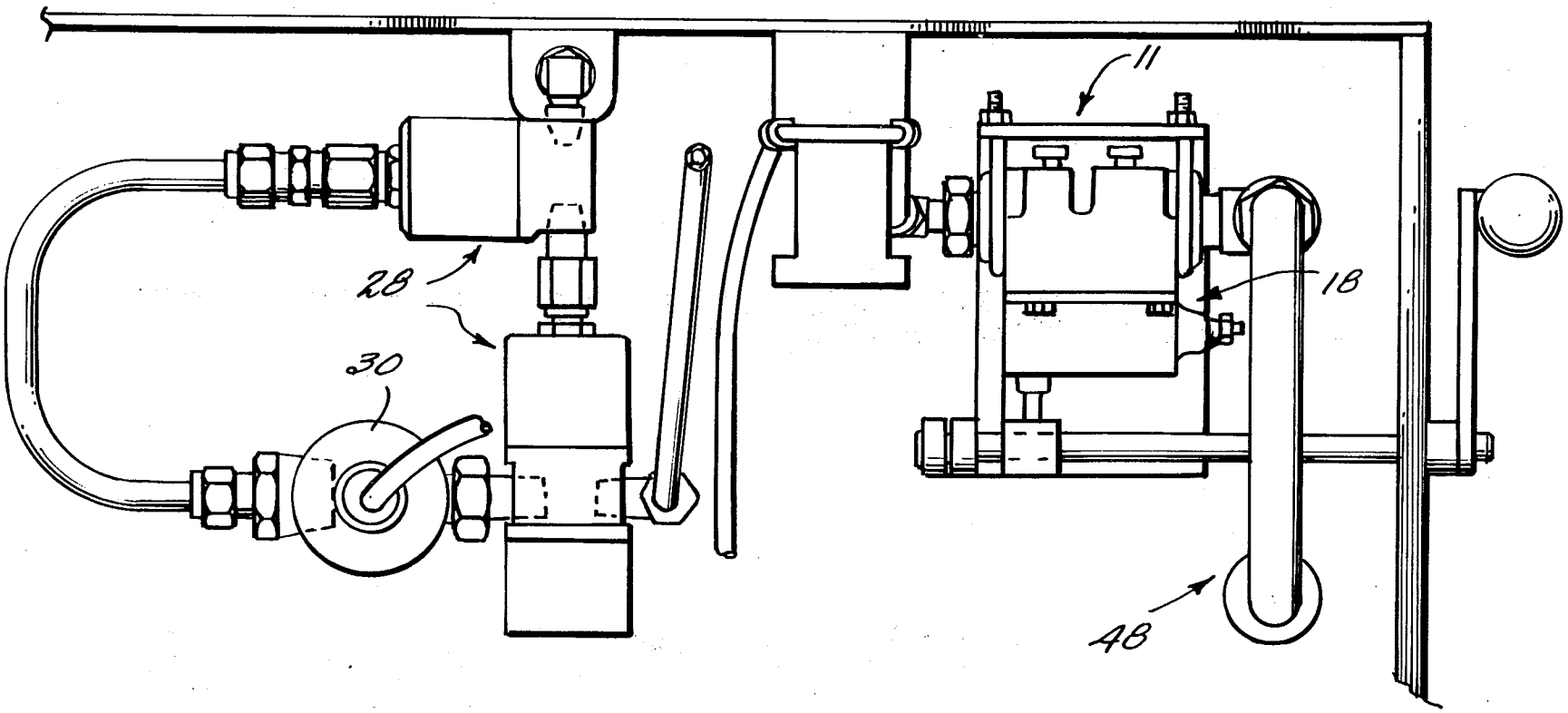
FIG. 4 is a top view of the apparatus of FIG. 3 taken along lines 4—4 thereof.

The cigarettes 14 held by the holding means 12 according to the present invention may be lit by a gas burner system such as that shown generally at 48 in FIGS. 2–4. The system 48 may generally include a reservoir tank 50, a burner 52 for each port 12, and controls 53, 54 for the burners 52 and a pilot therefor.

The burners 52 are preferably mounted on a movable mounting assembly 55 or the like. The assembly 55 is supported on the bottom thereof by a plate 56 having a rack 57 attached thereto, and by reciprocation of the rack 57, the positions of the burners 52 are adjusted to compensate for cigarettes 14 of different lengths that are to be lit thereby. The rack 57 may be reciprocated by turning a knob 58 having a gear 59 associated therewith which engages the rack 57.

Operation of the device according to the present invention is as follows: A cigarette 14 is placed in any number of the holding means 12 desired. The vacuum is set by adjusting the pressure relief valve 38 in reservoir 34, and the main valve 32 is opened. The solenoid-operated valve 20 associated with a valve set 18, 22 of a holding means 12 to be calibrated is then opened, and flow through the selected holding means 12 and cigarette attached thereto is initiated by opening valve 18. The valve 22 is set by adjustment of knob 23 until the desired flow through the selected holding means 12 is achieved. With valve 18 closed, the dummy load valve 16 associated with the selected holding means 12 is adjusted by operation of the control handle 17 until the resistance to the flow of air provided by the valve 16 substantially corresponds to that provided by the cigarette 14. The flow is tested by operation of valves 28 so that the flowmeter 30 is put in circuit with the manifold 24 and reservoir 34. The puff interval and duration desired is then adjusted by adjusting the controls 41 on panel 40 for the timed solenoid-operated valve 18 associated with the selected port 12. Then the valve 20 is shut off and the calibrating procedure is repeated for each of the ports 12 that are to be used so that the desired puff interval, duration, and flow is separately determined for each of the ports 12.

The cigarettes 14 are lit either manually with matches or the like, or by burner system 48. Once the cigarettes are lit, the whole system is allowed to operate with pump 26 providing the force for sucking air and smoke through manifold 24. Of course, the gases passing into manifold 24 may be analyzed if desired by any suitable conventional means, or the gases may be analyzed at any other point in the fluid circuit.

It will thus be seen that according to the present invention a smoking machine has been provided that provides for a wide adjustability of parameters for testing cigarettes and/or cigarette smoke, thus accomplishing the objects of the present invention. While the invention has been herein shown and described in what is presently conceived to be the most practical and preferred embodiment of the invention, it will be apparent that many modifications thereof may be made within the scope of the invention, which scope is to be accorded the broadest interpretation of the appended claims so as to encompass all equivalent structures and devices.

What is claimed is:

1. A smoking machine comprising
   a. a plurality of means for holding a cigarette or the like for smoking,
   b. a continuous source of vacuum,
   c. a plurality of dummy air-flow resistance means, one corresponding to each of said holding means, the air-flow resistance of said dummy means being adjustable to be substantially the same as a cigarette or the like being held by the corresponding holding means,
   d. means for operatively connecting said continuous source of vacuum to said plurality of holding means and to said plurality of dummy air-flow resistance means, and
   e. a first valve means associated with each holding and disposed in said connecting means for selectively placing each of said holding means in communication with said vacuum source so that air and smoke are drawn through a cigarette in said holding means toward said vacuum source to provide a puff, said valve means in a first position thereof placing said holding means in operative communication with said vacuum source and said dummy means not being in communication with said vacuum source, and in a second position thereof placing said dummy means in operative communication with said vacuum source and said holding means not being in communication with said vacuum source.

2. A smoking machine as recited in claim 1 further comprising adjustable timing means for remotely controlling each of said first valve means for automatically controlling the duration and interval of a puff of a cigarette held by each of said holding means.

3. A smoking machine as recited in claim 2 further comprising an adjustable flow control valve disposed between each of said first valve means and said vacuum source for adjustably controlling the flow through each of said holding means.

4. A smoking machine as recited in claim 3 further comprising a flowmeter and a flowmeter bypass line disposed in a fluid circuit between said flow control valve and said vacuum source, and valve means for selectively inserting said flowmeter or said flowmeter bypass line in communication with said flow control valve and said vacuum source.

5. A smoking machine as recited in claim 1 wherein said vacuum source includes a vacuum pump and a reservoir with a relief valve disposed between said vacuum pump and each of said first valve means.

6. A smoking machine as recited in claim 1 further comprising solenoid-operated second valve means disposed between said vacuum source and each of said first valve means for selectively permitting or preventing flow of air from said holding means through each of said first valve means toward said vacuum source.

7. A smoking machine comprising means for holding a cigarette or the like for smoking, a continuous source of vacuum, a dummy air-flow resistance means corresponding to said holding means, the air-flow resistance of said dummy means being adjustable to be substantially the same as a cigarette or the like being held by said holding means, first valve means for selectively placing said holding means in communication with said vacuum source so that air and smoke are drawn through a cigarette in said holding means toward said vacuum source to provide a puff, said valve means in a first position thereof placing said holding means in operative communication with said vacuum source and said dummy means not being in communication with said vacuum source, and in a second position thereof placing said dummy means in operative communication with said vacuum source and said holding means not being in communication with said vacuum source, adjustable timing means for remotely controlling said first valve means for automatically controlling the duration and interval of a puff of a cigarette held by said holding means, an adjustable flow control valve disposed between said first valve means and said vacuum source for adjustably controlling the flow through said holding means, characterized in that a plurality of said holding means, dummy means, first valve means, and flow control valves are provided arranged in sets, and further comprising a pressure manifold operatively connecting said sets to said vacuum source.

8. A smoking machine as recited in claim 7 wherein said system includes means for trapping and condensing elements of smoke from cigarettes held by said holding means.

9. A smoking machine as recited in claim 8 further comprising a flowmeter and a flowmeter bypass line disposed in parallel in a fluid circuit between said pressure manifold and said vacuum source, and valve means for selectively inserting said flowmeter or said flowmeter bypass line in communication with said pressure manifold and said vacuum source.

* * * * *